US008979317B2

(12) United States Patent
Nakamura

(10) Patent No.: US 8,979,317 B2
(45) Date of Patent: Mar. 17, 2015

(54) LUMINOUS FLUX CONTROL MEMBER AND ILLUMINATION DEVICE

(75) Inventor: Masato Nakamura, Saitama (JP)

(73) Assignee: Enplas Corporation, Saitama (JP)

( * ) Notice: Subject to any disclaimer, the term of this patent is extended or adjusted under 35 U.S.C. 154(b) by 0 days.

(21) Appl. No.: 13/983,096

(22) PCT Filed: Jan. 17, 2012

(86) PCT No.: PCT/JP2012/000238

§ 371 (c)(1),
(2), (4) Date: Aug. 1, 2013

(87) PCT Pub. No.: WO2012/105168

PCT Pub. Date: Aug. 9, 2012

(65) Prior Publication Data

US 2013/0314926 A1 Nov. 28, 2013

(30) Foreign Application Priority Data

Feb. 3, 2011 (JP) ..... 2011-021586

(51) Int. Cl.

| | |
|---|---|
| ***F21V 5/00*** | (2006.01) |
| ***F21V 5/04*** | (2006.01) |
| ***F21K 99/00*** | (2010.01) |
| *F21V 3/00* | (2006.01) |

(Continued)

(52) U.S. Cl.

CPC . *F21V 5/04* (2013.01); *F21K 9/135* (2013.01); *F21K 9/50* (2013.01); *F21V 5/008* (2013.01); *F21V 3/00* (2013.01); *F21V 7/0091* (2013.01); *F21Y 2101/02* (2013.01)

USPC ..... 362/268; 362/309; 362/327; 362/331

(58) Field of Classification Search

CPC ..... F21V 5/04; F21V 5/008; F21V 5/048; F21V 13/02; F21V 13/04; F21V 7/041; F21V 7/046; F21V 7/09; F21Y 2101/02; F21K 9/00

USPC ..... 362/308, 309, 311.02, 311.06–311.1, 362/268, 331, 333–339

See application file for complete search history.

(56) References Cited

U.S. PATENT DOCUMENTS

| | | | | |
|---|---|---|---|---|
| 6,679,621 | B2 | 1/2004 | West et al. | |
| 8,070,329 | B1 * | 12/2011 | Bechtel et al. | 362/331 |
| 2006/0067640 | A1 | 3/2006 | Hsieh et al. | |

(Continued)

FOREIGN PATENT DOCUMENTS

| | | | |
|---|---|---|---|
| JP | 2001-243807 | A | 9/2001 |
| JP | 2004-133391 | A | 4/2004 |

(Continued)

*Primary Examiner* — Thomas M Sember

(74) *Attorney, Agent, or Firm* — Brundidge & Stanger, P.C.

(57) ABSTRACT

An illumination device (1) has a light-emitting element (6*b*), and a luminous flux control member (6*c*) that includes a first lens (10) and a second lens (20). The first lens (10) and the second lens (20) are assembled such that a first surface (10*c*) and a second rear surface (20*a*) are in contact, or such that a minute gap exists between the first surface (10*c*) and the second rear surface (20*a*). A first conical concave surface (10*d*) having its apex on the central axis (C) is formed by indenting a first rear surface (10*a*). A second concave surface (20*d*), having its apex on the central axis (C) and having a curved shape the curvature of which decreases as the distance from the central axis increases, is formed by indenting a second surface (20*c*).

9 Claims, 15 Drawing Sheets

(51) Int. Cl.
*F21V 7/00* (2006.01)
*F21Y 101/02* (2006.01)

(56) References Cited

U.S. PATENT DOCUMENTS

2006/0077685 A1 4/2006 Hsieh et al.
2006/0083003 A1 4/2006 Kim et al.
2007/0104963 A1 5/2007 Hsieh et al.
2008/0112156 A1 5/2008 Hsieh et al.
2012/0169204 A1* 7/2012 Wu et al. ..... 313/116

FOREIGN PATENT DOCUMENTS

JP 2006-099117 A 4/2006
JP 2006-113556 A 4/2006

* cited by examiner

LUMINOUS FLUX CONTROL MEMBER AND ILLUMINATION DEVICE

TECHNICAL FIELD

The present invention relates to a light flux controlling member for controlling a distribution of light emitted from a light-emitting element, and an illumination device having the light flux controlling member.

BACKGROUND ART

Traditional incandescent light bulbs generate a wide range of uniform light from a filament by supplying electric power from an external power source to the filament. However, the incandescent light bulbs have disadvantages such that power consumption is high, temperature is high, and lifespan is short.

In contrast, since light-emitting diode (LED) bulbs have advantages such that lifespan is long, power can be saved, environmental pollution caused by waste does not occur, the LED bulbs are becoming lighting fixtures of a new age instead of the incandescent light bulbs. However, since the LEDs emit light only in a forward direction, when an LED bulb of the related art is attached to a ceiling, the light that is radiated to the ceiling and a wall surface decreases. Therefore, as compared to the incandescent light bulbs in which equivalent illuminance is obtained directly under a light bulb, it may look a bit darker with the LED bulbs.

In order to solve this problem, FIG. 4 of PTL 1 discloses an LED bulb with an expanded illumination angle, in which a substrate is formed in a cylindrical shape, LEDs are mounted on both a side surface (surface parallel to the axis of the LED bulb) of the cylinder and an upper surface (surface perpendicular to the axis of the LED bulb) of the cylinder, and the light emitted from the LEDs is diffused by a fluorescent material layer formed in the inner surface of a translucent cover and is emitted to the outside of the LED bulb.

CITATION LIST

Patent Literature

PTL 1

Japanese Patent Application Laid-Open No. 2001-243807

SUMMARY OF INVENTION

Technical Problem

However, since the LED bulb of the related art described in the above PTL 1 has a complicated structure in terms of the shape of the substrate or the arrangement of the LEDs, manufacturing costs of the LED bulb become high.

An object of the present invention is to provide a light flux controlling member that can broadly expand light emitted from an LED, and an illumination device, such as an LED bulb with a simple structure and a wide illumination angle, which has the light flux controlling member.

Solution to Problem

The light flux controlling member according to the present invention is a light flux controlling member for controlling a distribution of light emitted from a light-emitting element. The light flux controlling member includes: a plate-shaped first lens; and a plate-shaped second lens, wherein the first lens has a first front surface that is one principal surface, a first rear surface that is the other principal surface, and a first side surface that forms a lateral contour of the first lens, the second lens has a second front surface that is one principal surface, a second rear surface that is the other principal surface, and a second side surface that forms a lateral contour of the second lens, and the first lens, and the second lens are arranged in an overlapping manner so that the first front surface and the second rear surface face each other and that a low refractive index layer having a lower refractive index than the first lens and the second lens is present between the first front surface and the second rear surface. The first lens has a first concave surface that is formed by indenting the first rear surface of the first lens and is configured to allow the light emitted from the light-emitting element to be incident on the first concave surface to generate light to be guided toward the first side surface, and the second lens has a second concave surface that is formed by indenting the second front surface of the second lens and is configured to emit or totally reflect the light that is incident on the first concave surface and is transmitted through the first front surface and the second rear surface.

The illumination device according to the present invention includes a light-emitting element and the above light flux controlling member for controlling a distribution of light emitted from the light-emitting element.

Advantageous Effects of Invention

According to the present invention, it is possible to provide an illumination device, such as an LED bulb, which can broadly expand light emitted from the LED, and has a simple structure of one LED and the lenses (light flux controlling member), and a wide illumination angle.

DESCRIPTION OF EMBODIMENTS

Hereinafter, embodiments of the present invention will be described in detail with reference to the drawings. In the following description, an LED bulb that has an LED as a light-emitting element will be described as a representative example of an illumination device of the present invention.

(Configuration of LED Bulb)

Figure 1:
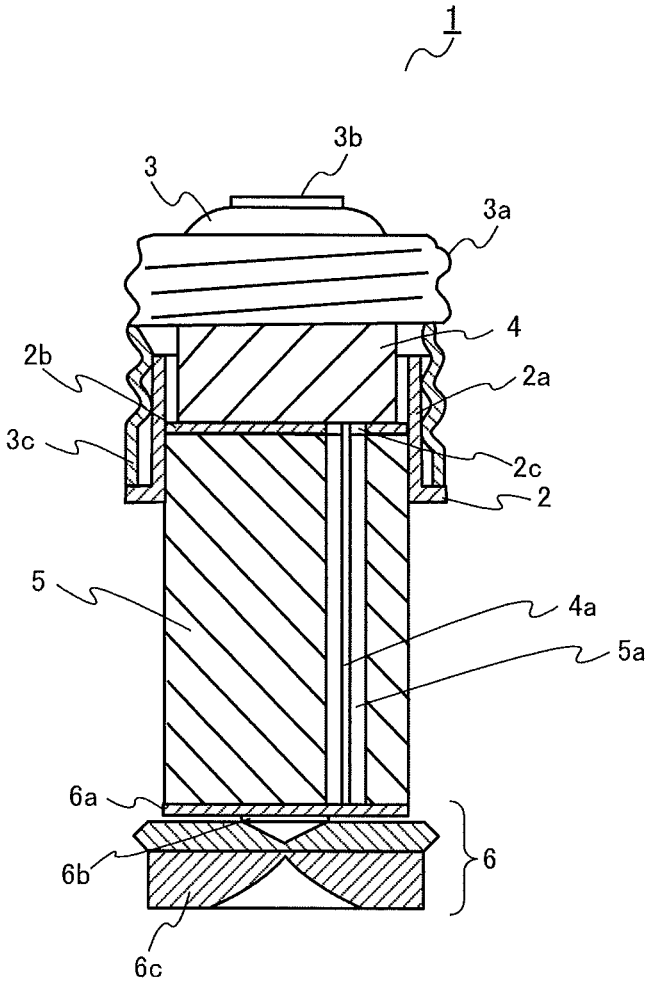
FIG. 1 illustrates an LED bulb that has a light flux controlling member according to an embodiment of the present invention.

FIG. 1 illustrates LED bulb 1 having a light flux controlling member according to an embodiment of the present invention.

LED bulb 1 is mainly constituted by cover 2, base 3, power source unit 4, pedestal 5, and LED unit 6.

Cover 2 is made of a metal (for example, aluminum) that has high heat conductivity. Cover 2 is formed with cylindrical base attachment part 2*a*. Disk-shaped supporting member 2*b* that has hole 2*c* at a central part thereof is attached to an inner surface of base attachment part 2*a* with an adhesive or the like, and power source unit 4 is disposed on the inner surface of supporting member 2*b*.

Base 3 has metallic shell part 3*a* that is formed in a cylindrical shape including a thread, and metallic eyelet part 3*b* that is provided via an insulating section with respect to shell part 3*a* at a top part on one end side of shell part 3*a*. Base 3 is fixed to cover 2 by mounting opening 3*c*, which is the other end side of shell part 3*a*, on base attachment part 2*a* of cover 2 via an insulator.

Power source unit 4 is substantially columnar, and is connected to shell part 3*a* and the inner surface of eyelet part 3*b* via an input electric wire (not shown) so as to receive supply of electric power from base 3. Additionally, power source unit 4 supplies electric power to LED unit 6 via output electric wire 4*a*.

Pedestal 5 is substantially columnar and is attached to the inner surface of cover 2 by a heat-conductive binding material. Through hole 5*a* that passes through pedestal 5 in the thickness direction is provided near the center of pedestal 5. Output electric wire 4*a* connected to power source unit 4 is connected to substrate 6*a* of LED unit 6 through hole 2*c* of supporting member 2*b* and through hole 5*a* of pedestal 5.

LED unit 6 is constituted by substrate 6*a*, LED 6*b*, and light flux controlling member 6*c*. LED unit 6 is attached to pedestal 5 by bonding the rear surface of substrate 6*a* to pedestal 5. Substrate 6*a* is made of a metal (for example, aluminum) that has high heat conductivity. LED 6*b* that emits visible light is mounted on the front surface of substrate 6*a*. LED 6*b* is connected to a wiring pattern (not shown) made of copper foil formed on the front surface of substrate 6*a* via an insulating layer. Light flux controlling member 6*c* is attached to substrate 6*a* so as to face LED 6*b*, and controls a traveling direction of the light emitted from LED 6*b*. In addition, the shape or the like of light flux controlling member 6*c* will be described below in detail.

If LED bulb 1 is attached to a bulb socket (not shown), shell part 3*a* and eyelet part 3*b* of base 3 contact an electrode within the socket, and the electric power from a commercial power source (not shown) is supplied to power source unit 4. Power source unit 4 supplies, for example, electric power of a direct current of 160 mA to LED 6*b* on substrate 6*a* via output electric wire 4*a*. LED 6*b* emits light, if electric power is supplied thereto. The light emitted from LED 6*b* is emitted while the traveling direction thereof is controlled by light flux controlling member 6*c*.

(Shape of Light Flux Controlling Member)

Figure 2A:
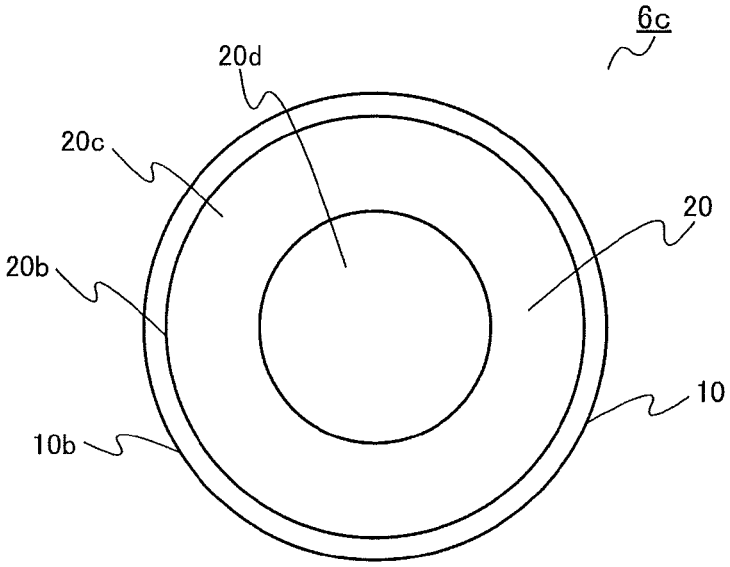
FIG. 2A is a plan view of the light flux controlling member.
Figure 2B:
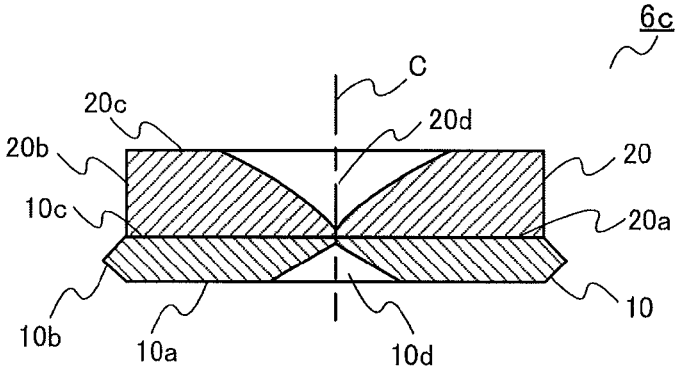
FIG. 2B is a front cross-sectional view of the light flux controlling member.
Figure 2C:
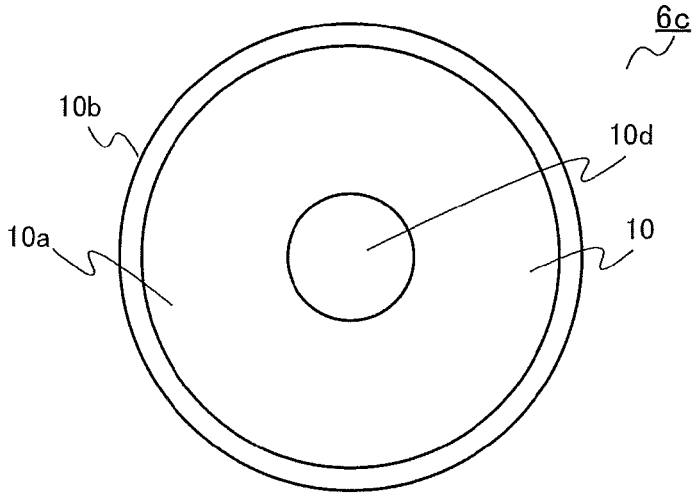
FIG. 2C is a bottom view of the light flux controlling member.

FIGS. 2A to 2C illustrate the light flux controlling member according to the present embodiment. FIG. 2A is a plan view of light flux controlling member 6*c*, FIG. 2B is a front cross-sectional view of light flux controlling member 6*c*, and FIG. 2C is a bottom view of light flux controlling member 6*c*. As shown in FIG. 2, light flux controlling member 6*c* according to the present embodiment is mainly constituted by plate-shaped first lens 10 and plate-shaped second lens 20.

Both first lens 10 and second lens 20 are formed of, for example, transparent resin materials, such as polymethyl methacrylate (PMMA), polycarbonate (PC), epoxy resin (EP), and cycloolefin resin (COP), or transparent glass. In addition, first lens 10 and second lens 20 may be formed of mutually different materials.

First lens 10 is formed in a thin columnar shape, and has first rear surface 10*a* that is one principal surface, first side surface 10*b* that forms a lateral contour of first lens 10, and first front surface 10*c* that is the other principal surface. First rear surface 10*a* and first front surface 10*c* are circular planes, and first side surface 10*b* has a convex prism-shape over the entire circumference thereof. A first concave surface 10*d*, having its apex on a central axis C and having a conical surface shape, is formed at a central part of first rear surface 10*a* by indenting first rear surface 10*a*. As described below, first concave surface 10*d* is configured to allow the light emitted from LED 6*b* is incident on first concave surface 10*d* to generate light to be guided toward first side surface 10*b*.

Second lens 20 is formed in a thin columnar shape, and has second rear surface 20*a* that is one principal surface, second side surface 20*b* that forms a lateral contour of second lens 20, and second front surface 20*c* that is the other principal surface. Second rear surface 20*a* and second front surface 20*c* are circular planes, and second side surface 20*b* is a circumferential curved surface with a constant diameter. Second concave surface 20*d*, having its apex on the central axis C and having a curved shape of which the curvature decreases as a distance from the central axis increases, is formed at a center part of second front surface 20*c* by indenting second surface 20*c*. As described below, second concave surface 20*d* is configured to emit or totally reflect the light that is incident on first concave surface 10*d* and is transmitted through first front surface 10*c* and second rear surface 20*a*.

(Assembling of Lens of Light Flux Controlling Member)

First lens 10 and second lens 20 are assembled in a state where first front surface 10*c* and second rear surface 20*a* are in contact or in a state where a minute gap is present between first front surface 10*c* and second rear surface 20*a*. Even in any cases, first lens 10 and second lens 20 are not in close contact with each other, but an air space is present between first front surface 10*c* and second rear surface 20*a*. The air space functions as a low refractive index layer having a refractive index lower than first lens 10 and second lens 20.

In addition, the present invention has no limitation on a method of assembling first lens 10 and second lens 20.

Figure 3A:
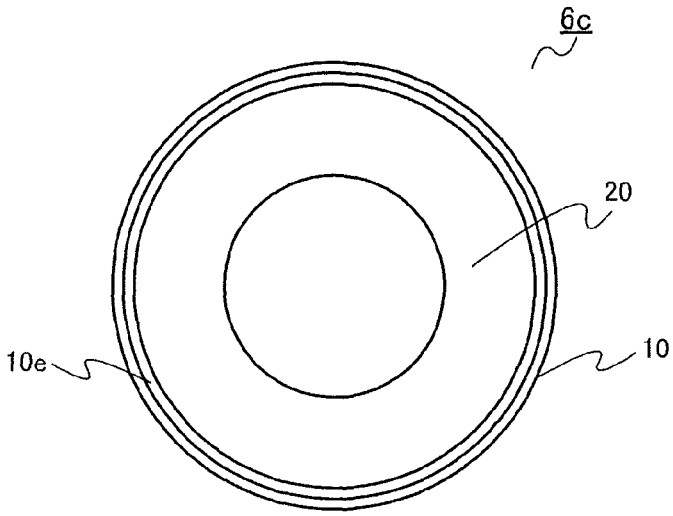
FIG. 3A is a plan view of the light flux controlling member.
Figure 3B:
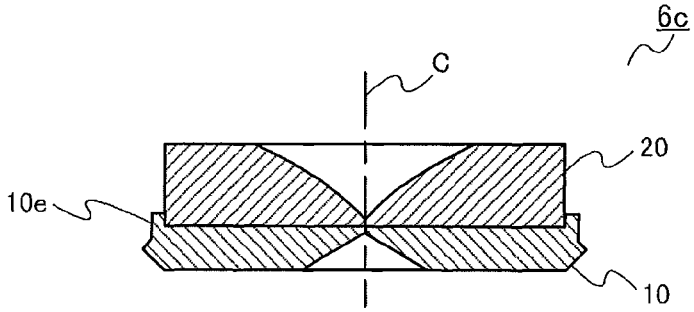
FIG. 3B is a front cross-sectional view of the light flux controlling member.
Figure 3C:
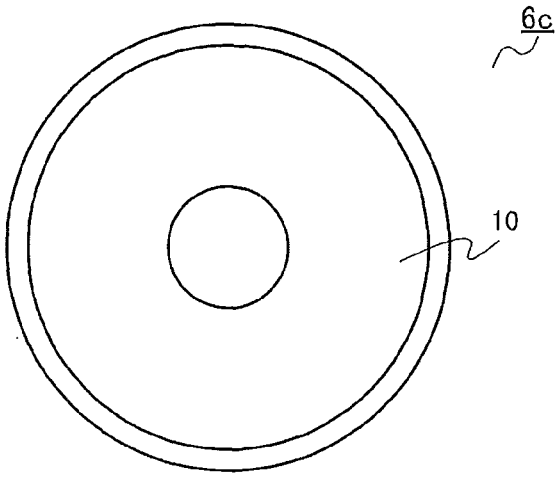
FIG. 3C is a bottom view of the light flux controlling member.

For example, as shown in FIGS. 3A to 3C, first lens 10 and second lens 20 can be assembled by forming annular convex edge part 10*e* having an internal diameter that is approximately equal to the outer shape of second lens 20 on an outer peripheral part of first front surface 10*c* of first lens 10, and fitting second lens 20 into convex edge part 10*e* of first lens 10.

Otherwise, first lens 10 and second lens 20 can be assembled by providing first front surface 10*c* of first lens 10 with a plurality of minute indents, providing second rear surface 20*a* of second lens 20 with projections corresponding to the indents, and fitting the respective projections into the respective indents.

Otherwise, first lens 10 and second lens 20 can be assembled by providing second rear surface 20*a* of second lens 20 with a plurality of projections of which the upper surfaces are planes and bonding the upper surfaces of the respective projections to first front surface 10*c* of first lens 10 with an adhesive.

Even in any assembling examples, the concavo-convex fitting parts or the bonding parts are designed so as not to have a great influence on the optical properties of light flux controlling member 6*c*.

(Attachment of Light Flux Controlling Member)

Light flux controlling member 6*c* in which first lens 10 and second lens 20 are assembled is attached to substrate 6*a* so that first rear surface 10*a* faces LED 6*b* and the central axis C of light flux controlling member 6*c* coincides with an optical axis L of LED 6*b*.

The optical axis L means the traveling direction of a virtual light ray that is representative of a light flux, is emitted perpendicularly to a light-emitting surface of LED 6*b* from the center of the light-emitting surface, and is located at the center of a three-dimensional luminous flux emitted from LED 6*b*.

In addition, the present invention has no limitation on a method of attaching light flux controlling member 6*c* to substrate 6*a*.

For example, light flux controlling member 6*c* can be attached to substrate 6*a* by providing first rear surface 10*a* of first lens 10 with a plurality of projections of which the upper surfaces are planes, and bonding the upper surfaces of the respective projections to substrate 6*a* with an adhesive.

Otherwise, light flux controlling member 6*c* can be attached to substrate 6*a* by providing substrate 6*a* with a plurality of indents or through holes, providing first rear surface 10*a* of first lens 10 with projections corresponding to the indents, and fitting the respective projections into the respective indents.

(Path of Light within Light Flux Controlling Member)

Figure 4A:
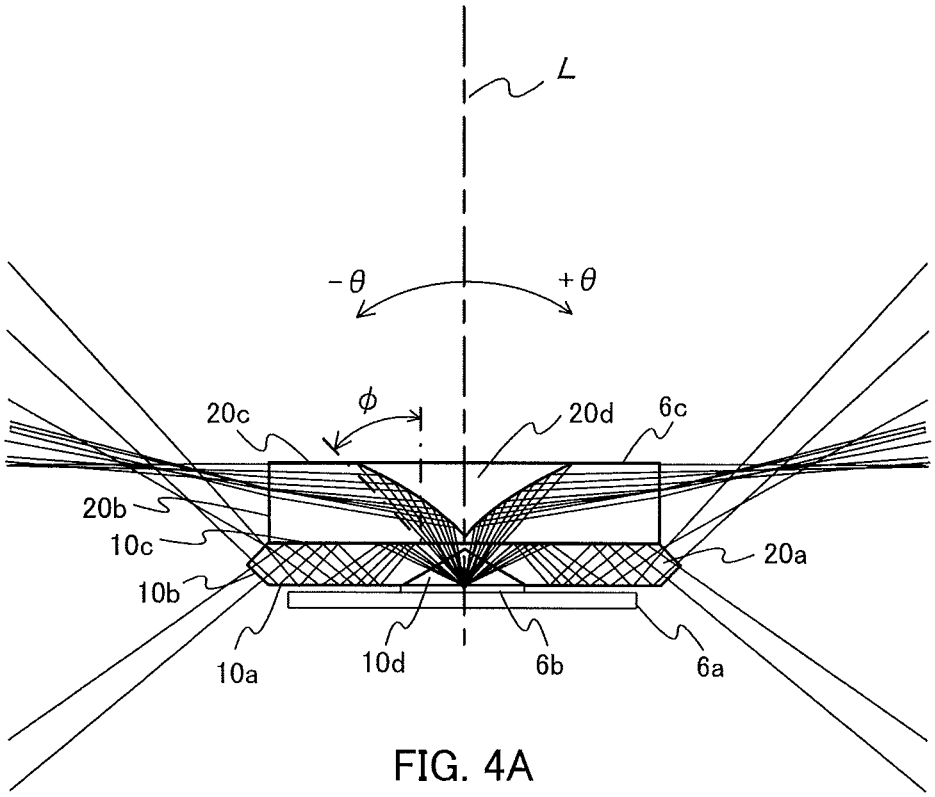
FIG. 4A illustrates the path of the light that is emitted from the center of a light-emitting surface of an LED and is incident on the light flux controlling member.
Figure 4B:
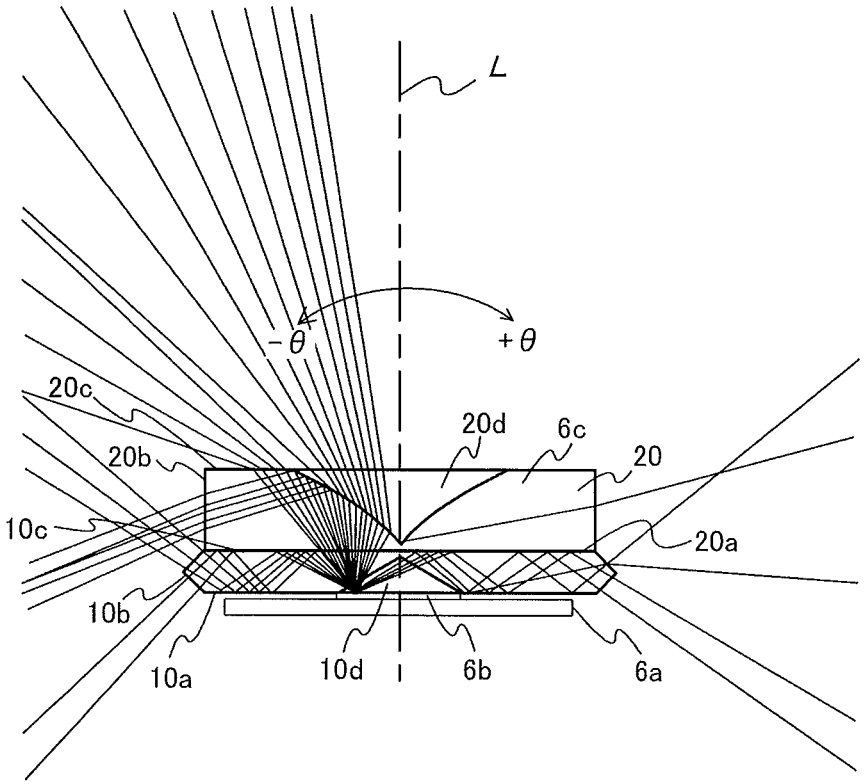
FIG. 4B illustrates the path of the light that is emitted from a point distant from the center of the light-emitting surface of the LED and is incident into the light flux controlling member.

FIG. 4 illustrates the optical path of the light that is incident on light flux controlling member 6*c*. FIG. 4A illustrates the optical path of the light emitted from the center of the light-emitting surface of LED 6*b*, and FIG. 4B illustrates the optical path of the light emitted from a point that is distant from the center of the light-emitting surface of LED 6*b*. In addition, in the following description, the angle of the traveling direction of light with respect to the optical axis L (central axis C) is defined as θ.

As shown in FIGS. 4A and 4B, LED 6*b* emits light radially from the light-emitting surface. Most of the light emitted from LED 6*b* is incident on the first concave surface 10*d* of first lens 10. The absolute value of the angle θ of the traveling direction of the light emitted from LED 6*b* becomes smaller than 90°.

As shown in FIGS. 4A and 4B, the light that reaches first front surface 10*c* at an angle equal to or smaller than a critical angle ϕ which varies depending on the material of first lens 10 out of the light that is incident on first concave surface 10*d* is emitted from first front surface 10*c*, and is incident into second lens 20 from second rear surface 20*a* of second lens 20. On the other hand, the light that reaches first front surface 10*c* at an angle greater than the critical angle ϕ is totally reflected at first front surface 10*c*, then travels between first rear surface 10*a* and first front surface 10*c* while being reflected, and is emitted from first side surface 10*b*. In a case where the material of first lens 10 is acryl, the critical angle ϕ is about 42°.

In a case where the light emitted from LED 6*b* is incident into first lens 10 from first rear surface 10*a* in which first concave surface 10*d* is not formed, a substantially total amount of light is emitted from first front surface 10*c*, and the light to be guided inside first lens 10 is not generated. Accordingly, it is necessary to form first concave surface 10*d* with an inclining surface of which the concave space is tapered as it approaches first front surface 10*c*.

As shown in FIG. 4A, the light that is incident into second lens 20 from second rear surface 20*a* out of the light emitted from one point (the center of the light-emitting surface in the present embodiment) of the light-emitting surface of LED 6*b* is totally reflected by second concave surface 20*d*, and is emitted mainly from second side surface 20*b*.

Additionally, as shown in FIG. 4B, a portion of the light that is incident on second rear surface 20*a* out of the light emitted from another point (a point that is distant from the center in the present embodiment) of the light-emitting surface of LED 6*b* is emitted from second front surface 20*c* or second concave surface 20*d*, and the remaining light is totally reflected by second concave surface 20*d* and is emitted from second side surface 20*b*. As LED 6*b* emits light not in a dotted shape but in a planar shape, both light that is totally reflected and light that is refracted and emitted can be generated at second concave surface 20*d*.

As shown in FIGS. 4A and 4B, the absolute value of the angle θ in the traveling direction of a portion of the light emitted from first side surface 10*b* or second side surface 20*b* becomes greater than 90°. That is, light flux controlling member 6*c* broadly expands and emits the light emitted from LED 6*b*. By forming first side surface 10*b* with a downward inclining surface (an inclining surface that approaches first rear surface 10*a* and approaches the optical axis L), it is possible to increase the amount of light emitted to the back ($-90° \geq \theta$, $+90° \leq \theta$).

(Contrast of Light Distribution)

Figure 5:
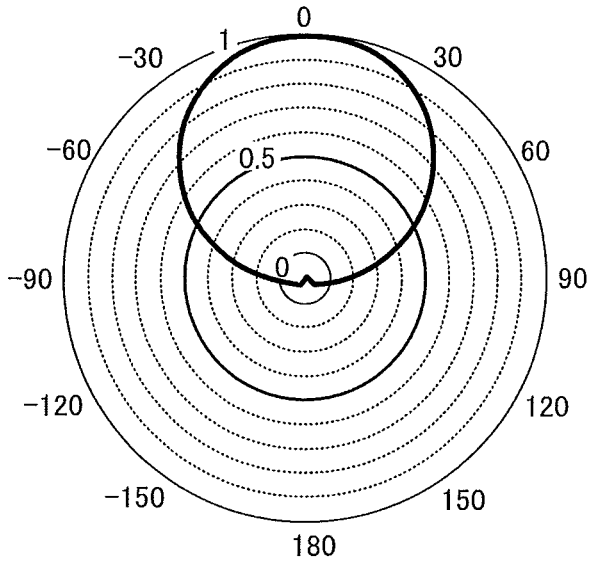
FIG. 5 illustrates the light distribution of an LED bulb of the related art.
Figure 6:
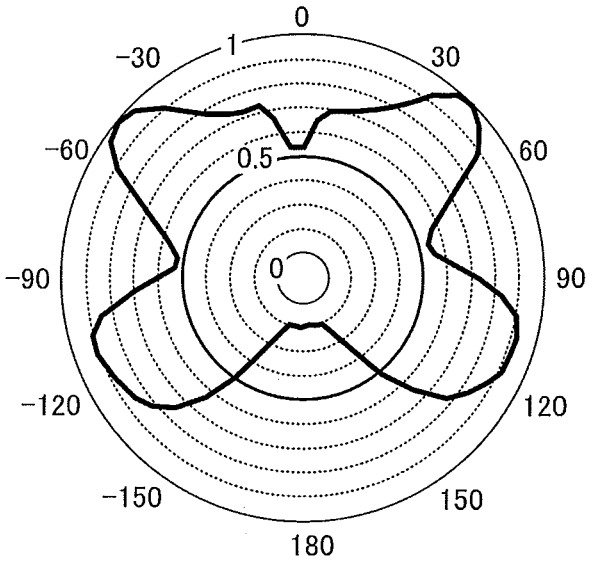
FIG. 6 illustrates the light distribution of an LED bulb that has the light flux controlling member according to the embodiment of the present invention.

FIG. 5 is a view showing the light distribution of an LED bulb of the related art that does not have light flux controlling member 6*c*, and FIG. 6 illustrates the light distribution of the LED bulb having light flux controlling member 6*c* according to the present embodiment.

As shown in FIG. 5, with the LED bulb of the related art, light is emitted only in a forward direction ($-90° < \theta < +90°$). In contrast, with the LED bulb that has light flux controlling member 6*c* according to the present embodiment, light is emitted even to the back ($-180° < \theta < -90°$ and $+90° < \theta \leq +180°$).

(Effects of Present Embodiment)

As described above, light flux controlling member 6*c* of the present embodiment is configured by attaching first lens 10 and second lens 20 in a state where an air space (low refractive index layer) is present between first front surface 10*c* and second rear surface 20*a*, and has first concave surface 10*d* and second concave surface 20*d*. Thereby, light flux controlling member 6*c* can broadly expand the light emitted from LED 6*b*. Accordingly, illumination devices, such as a LED bulb with a simple structure and a wide illumination angle, can be provided by using light flux controlling member 6*c*. In addition, although a case where first lens 10 and second lens 20 are made to overlap each other via the air space has been described in the present embodiment, the low refractive index layer is not limited to the air space. The low refractive index layer is not particularly limited if the light to be totally reflected by first front surface 10*c* is generated. For example, first lens 10 and second lens 20 may be bonded to each other with a low refractive index material having a refractive index lower than first lens 10 and second lens 20.

Moreover, according to the present embodiment, since the two lenses that constitute light flux controlling member 6*c* are plate-shaped and thin, formability of the respective lenses can be improved.

(Variations)

Variations of the light flux controlling member according to the present embodiment will be described below with reference to FIGS. 7 to 14.

Figure 7:
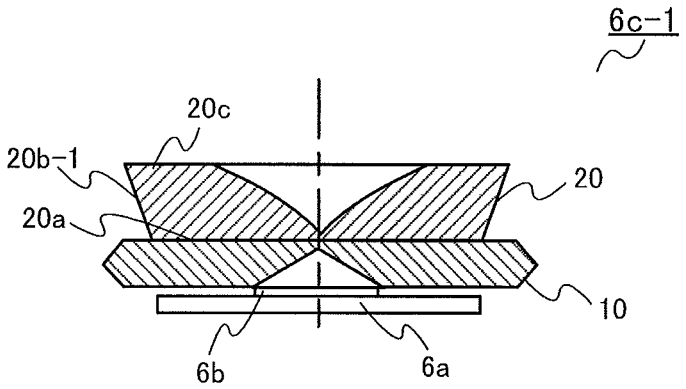
FIG. 7 illustrates the shape of the light flux controlling member of Variation 1 according to the embodiment of the present invention.
Figure 8:
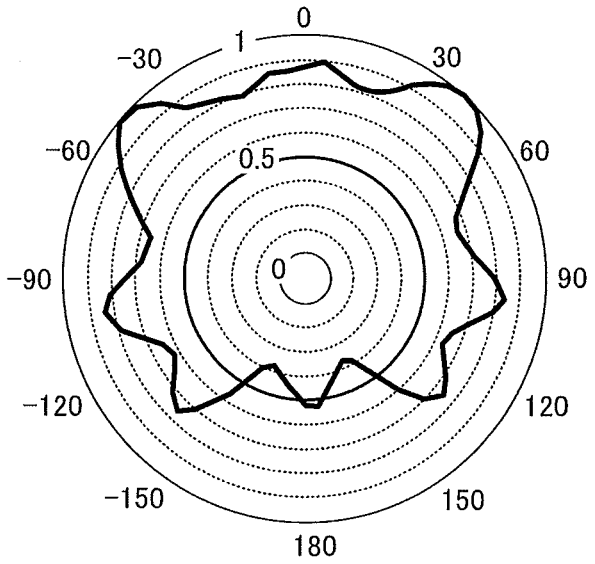
FIG. 8 illustrates the light distribution of an LED bulb having the light flux controlling member of FIG. 7.

FIG. 7 illustrates the shape of Variation 1 of the light flux controlling member according to the present embodiment, and FIG. 8 illustrates the light distribution of an LED bulb that has the light flux controlling member of FIG. 7. In addition, FIG. 7 illustrates light flux controlling member 6*c*-1 together with substrate 6*a* and LED 6*b*.

Light flux controlling member 6*c*-1 shown in FIG. 7 is different in terms of the shape of second side surface 20*b*-1 of second lens 20, compared to light flux controlling member 6*c* shown in FIG. 2. Second side surface 20*b*-1 is formed in a tapered shape over the entire circumference thereof, and a diameter of second side surface 20*b*-1 increases toward second front surface 20*c* from second rear surface 20*a*. Thereby, as is clear from the contrast between FIGS. 6 and 8, the amount of light on the front ($-90°<\theta<+90°$) can be increased compared to light flux controlling member 6*c* shown in FIG. 2.

Figure 9:
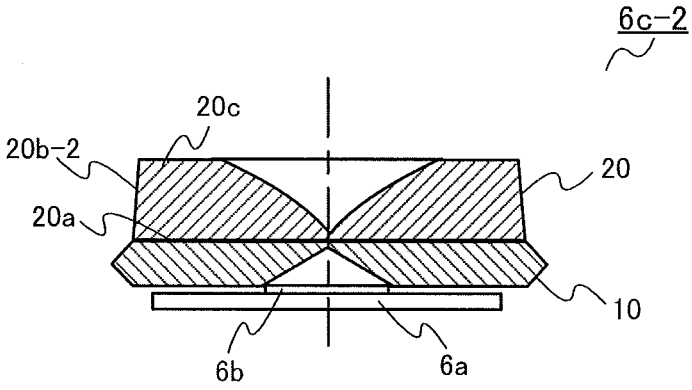
FIG. 9 illustrates the shape of the light flux controlling member of Variation 2 according to the embodiment of the present invention.
Figure 10:
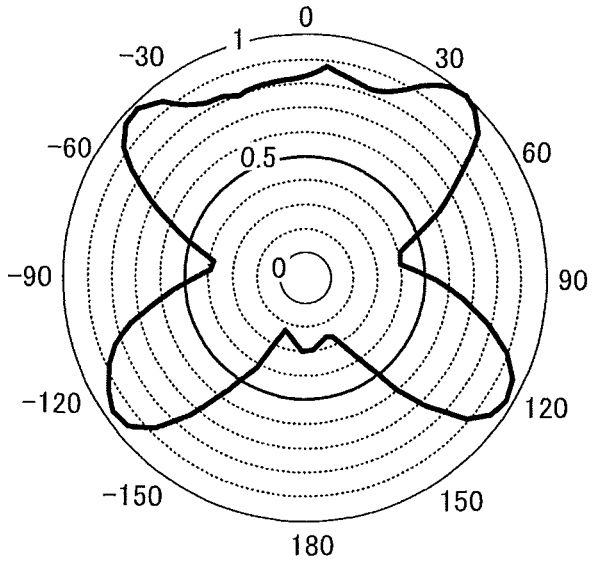
FIG. 10 illustrates the light distribution of an LED bulb having the light flux controlling member of FIG. 9.

FIG. 9 illustrates the shape of Variation 2 of the light flux controlling member according to the present embodiment, and FIG. 10 illustrates the light distribution of an LED bulb that has the light flux controlling member of FIG. 9. In addition, FIG. 9 illustrates light flux controlling member 6*c*-2 together with substrate 6*a* and LED 6*b*.

Light flux controlling member 6*c*-2 shown in FIG. 9 is different in terms of the shape of second side surface 20*b*-2 of second lens 20, compared to light flux controlling member 6*c* shown in FIG. 2. Second side surface 20*b*-2 is formed in a tapered shape over the entire circumference thereof, and a diameter of second side surface 20*b*-2 decreases toward second front surface 20*c* from second rear surface 20*a*. Thereby, as is clear from the contrast between FIGS. 6 and 10, the amount of light on the back ($-180°<\theta<-90°$ and $+90°<\theta\leq+180°$) can be increased compared to light flux controlling member 6*c* shown in FIG. 2.

Figure 11:
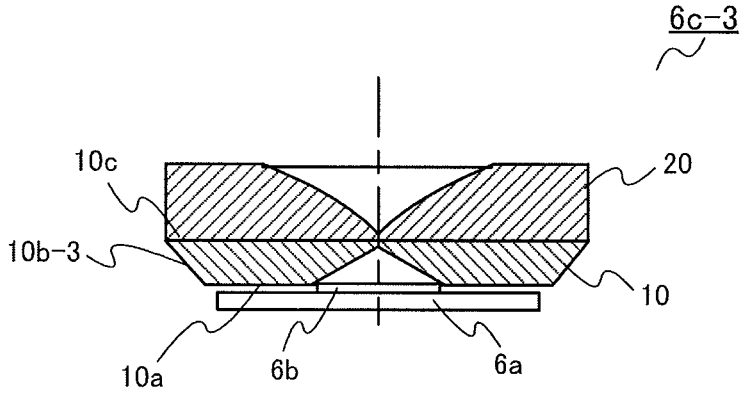
FIG. 11 illustrates the shape of the light flux controlling member of Variation 3 according to the embodiment of the present invention.
Figure 12:
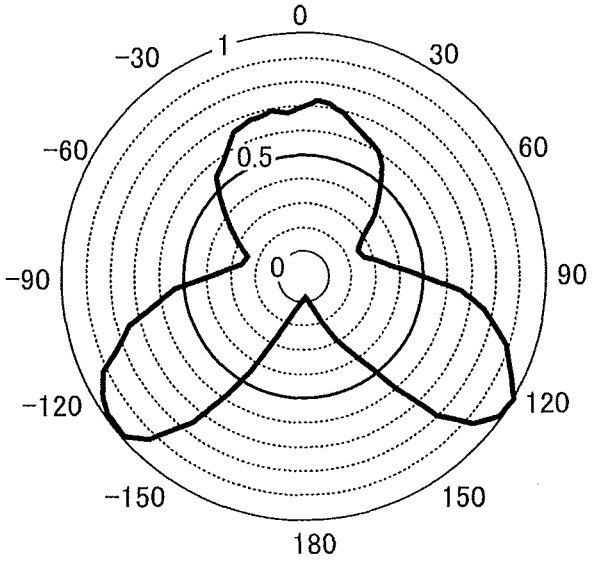
FIG. 12 illustrates the light distribution of an LED bulb having the light flux controlling member of FIG. 11.

FIG. 11 illustrates the shape of Variation 3 of the light flux controlling member according to the present embodiment, and FIG. 12 illustrates the light distribution of an LED bulb that has the light flux controlling member of FIG. 11. In addition, FIG. 11 illustrates light flux controlling member 6*c*-3 together with substrate 6*a* and LED 6*b*.

Light flux controlling member 6*c*-3 shown in FIG. 11 is different in terms of the shape of first side surface 10*b*-3 of first lens 10, compared to light flux controlling member 6*c* shown in FIG. 2. First side surface 10*b*-3 is formed in a tapered shape over the entire circumference thereof, and a diameter of the first side surface 10*b*-3 increases toward first front surface 10*c* from first rear surface 10*a*. Thereby, as is clear from the contrast between FIGS. 6 and 12, the amount of light on the back ($-180°<\theta<-90°$ and $+90°<\theta\leq+180°$) can be increased compared to light flux controlling member 6*c* shown in FIG. 2. Since the upward inclining surface (the tapered surface of which a diameter decrease toward first front surface 10*c*) is not formed, the amount of light emitted in the forward direction ($-90°<\theta<+90°$) decreases compared to light flux controlling member 6*c* shown in FIG. 2 in which the upward inclining surface is formed.

Figure 13:
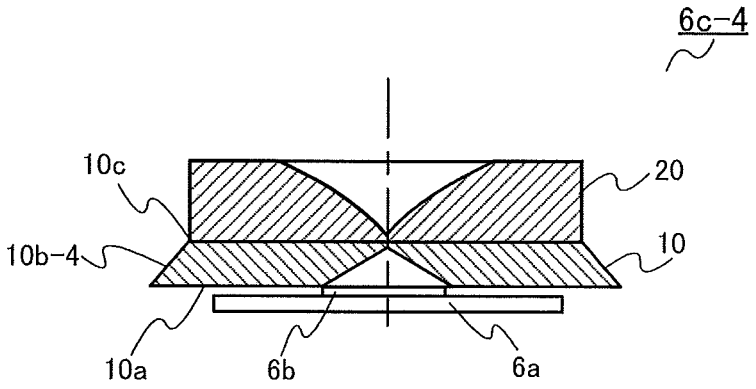
FIG. 13 illustrates the shape of the light flux controlling member of Variation 4 according to the embodiment of the present invention.
Figure 14:
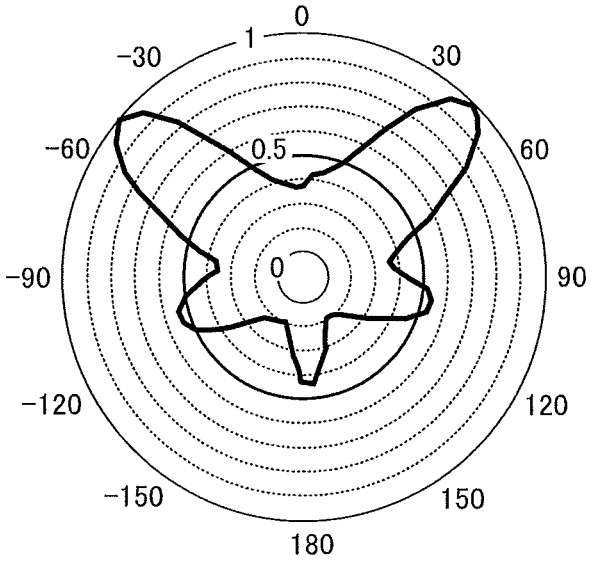
FIG. 14 illustrates the light distribution of an LED bulb having the light flux controlling member of FIG. 13.

FIG. 13 illustrates the shape of Variation 4 of the light flux controlling member according to the present embodiment, and FIG. 14 illustrates the light distribution of an LED bulb that has the light flux controlling member of FIG. 13. In addition, FIG. 13 illustrates light flux controlling member 6*c*-4 together with substrate 6*a* and LED 6*b*.

Light flux controlling member 6*c*-4 shown in FIG. 13 is different in terms of the shape of first side surface 10*b*-4 of first lens 10, compared to light flux controlling member 6*c* shown in FIG. 2. First side surface 10*b*-4 is formed in a tapered shape over the entire circumference thereof, and a diameter of the first side surface 10*b*-4 decreases toward first front surface 10*c* from first rear surface 10*a*. Thereby, as is clear from the contrast between FIGS. 6 and 14, the amount of light on the front ($-90°<\theta<+90°$) can be increased compared to light flux controlling member 6*c* shown in FIG. 2. Additionally, sine the area of first rear surface 10*a* is greater than the area of substrate 6*a*, and light can also be emitted from first rear surface 10*a*, the amount of light in the direction of $\theta=180°$ can also be increased.

By appropriately changing the shapes of the first concave surface, the second concave surface, the first side surface, and the second side surface, light flux controlling member 6*c* according to the present invention is able to adjust the amount of light in the direction of an emission angle $\theta$, and allows emission in all directions.

Figure 15:
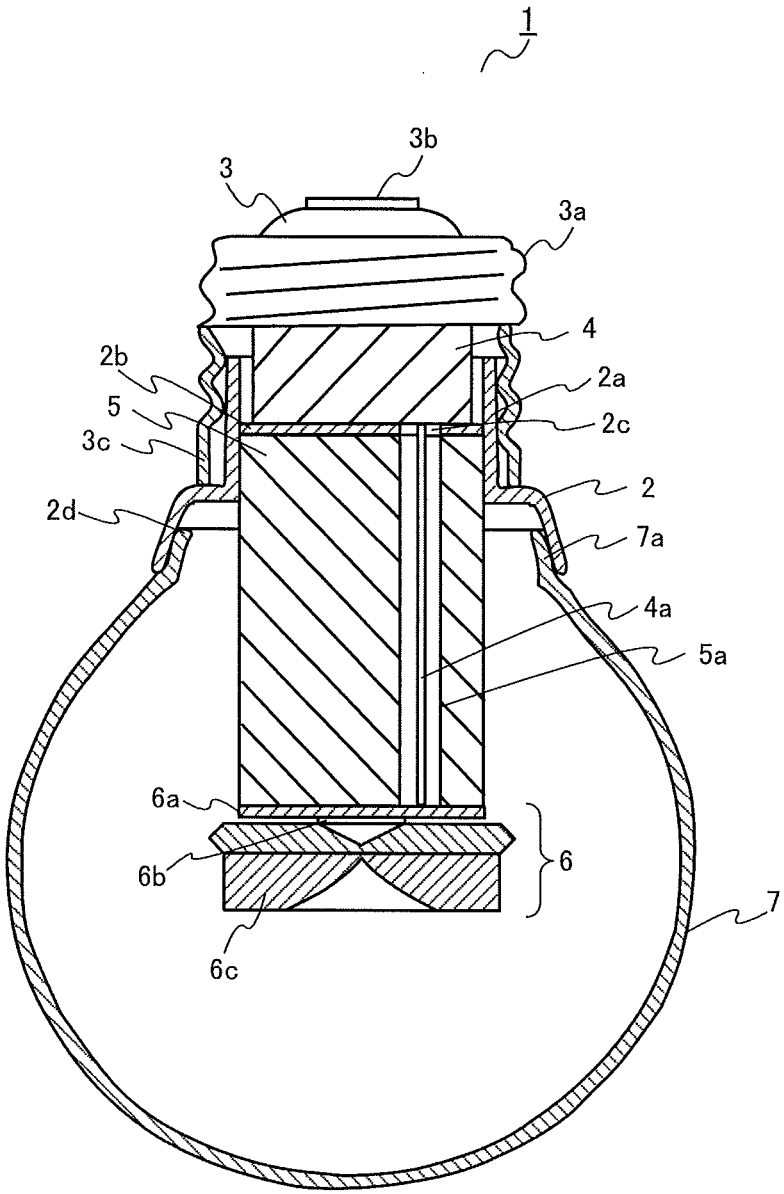
FIG. 15 illustrates a variation of the LED bulb having the light flux controlling member according to the embodiment of the present invention.

In the illumination device related to the invention, in order to further diffuse the light emitted from light flux controlling member 6*c* or to protect the LED unit, as shown in FIG. 15, globe 7 of which the surface is roughened or into which scattering particles or the like is mixed may be attached. In FIG. 15, an expanded annular globe attachment part 2*d* is formed in cover 2. Globe 7 is formed of a transparent resin material or transparent glass in a spherical shape of which end part 7*a* opens. End part 7*a* is fitted to the inside of globe attachment part 2*d* of cover 2 and is bonded thereto with an adhesive. Thereby, globe 7 is fixed to cover 2 so as to cover LED unit 6.

Additionally, a scattering material may be contained in light flux controlling member 6*c* in a range where the scattering material does not spoil the function of light flux controlling member 6*c*.

This application claims priority based on Japanese Patent Application No. 2011-021586 filed on Feb. 3, 2011. All the contents described in the specification and drawings of this application are incorporated in the specification of this application by reference.

INDUSTRIAL APPLICABILITY

The light flux controlling member according to the present invention can be widely utilized for illumination devices, such as an LED bulb.

REFERENCE SIGNS LIST

1 LED bulb
2 Cover

3 Base
4 Power source unit
5 Pedestal
6 LED unit
6*a* Substrate
6*b* LED
6*c* Light flux controlling member
7 Globe
10 First Lens
10*a* First rear surface
10*b* First side surface
10*c* First front surface
10*d* First concave surface
10*e* Convex edge part
20 Second lens
20*a* Second rear surface
20*b* Second side surface
20*c* Second front surface
20*d* Second concave surface

The invention claimed is:

1. A light flux controlling member for controlling a distribution of light emitted from a light-emitting element, the light flux controlling member comprising:

a plate-shaped first lens; and a plate-shaped second lens, wherein the first lens has a first front surface that is one principal surface, a first rear surface that is the other principal surface, and a first side surface that forms a lateral contour of the first lens, wherein the second lens has a second front surface that is one principal surface, a second rear surface that is the other principal surface, and a second side surface that forms a lateral contour of the second lens, wherein the first lens and the second lens are arranged in an overlapping manner so that the first front surface and the second rear surface face each other and that a low refractive index layer having a lower refractive index than the first lens and the second lens is present between the first front surface and the second rear surface, wherein the first lens has a first concave surface that is formed by indenting the first rear surface of the first lens and is configured to allow the light emitted from the light-emitting element to be incident on the first concave surface to generate light to be guided toward the first side surface, wherein the second lens has a second concave surface that is formed by indenting the second front surface of the second lens and is configured to emit or totally reflect the light that is incident on the first concave surface and is transmitted through the first front surface and the second rear surface, and wherein the first concave surface is inclined such that a concave space in the first lens is tapered toward the first front surface.

2. The light flux controlling member according to claim 1, wherein the first concave surface has a conical surface shape having its apex on a central axis of the first lens.

3. The light flux controlling member according to claim 1, wherein the second concave surface has its apex on a central axis of the second lens and has a curved shape of which the curvature decreases as a distance from the central axis increases.

4. The light flux controlling member according to claim 1, wherein the first side surface has a convex prism-shape over the entire circumference thereof.

5. The light flux controlling member according to claim 1, wherein the first side surface has a tapered shape over the entire circumference thereof, a diameter of the first side surface increasing toward the first front surface from the first rear surface.

6. The light flux controlling member according to claim 1, wherein the first side surface has a tapered shape over the entire circumference thereof, a diameter of the first side surface decreasing toward the first front surface from the first rear surface.

7. The light flux controlling member according to claim 1, wherein the second side surface has a tapered shape over the entire circumference thereof, a diameter of the second side surface increasing toward the second front surface from the second rear surface.

8. The light flux controlling member according to claim 1, wherein the second side surface has a tapered shape over the entire circumference thereof, a diameter of the second side surface decreasing toward the second front surface from the second rear surface.

9. An illumination device comprising:

a light-emitting element; and the light flux controlling member according to claim 1 for controlling a distribution of light emitted from the light-emitting element.

* * * * *